US007640962B2

(12) United States Patent
Meyer et al.

(10) Patent No.: US 7,640,962 B2
(45) Date of Patent: Jan. 5, 2010

(54) MULTIPLE TAPE APPLICATION METHOD AND APPARATUS

(75) Inventors: Thomas C. Meyer, Elkhart Lake, WI (US); Tim Parrish, Plymouth, WI (US); Jeff W. Fritz, Plymouth, WI (US)

(73) Assignee: Curt G. Joa, Inc., Sheboygan Falls, WI (US)

( * ) Notice: Subject to any disclaimer, the term of this patent is extended or adjusted under 35 U.S.C. 154(b) by 776 days.

(21) Appl. No.: 11/110,437

(22) Filed: Apr. 20, 2005

(65) Prior Publication Data

US 2005/0230056 A1 Oct. 20, 2005

Related U.S. Application Data

(60) Provisional application No. 60/563,634, filed on Apr. 20, 2004.

(51) Int. Cl.

| | |
|---|---|
| ***B29C 65/50*** | (2006.01) |
| ***B29C 65/56*** | (2006.01) |
| ***B32B 37/22*** | (2006.01) |
| ***B44C 1/24*** | (2006.01) |
| ***B65C 9/30*** | (2006.01) |
| ***B29C 65/80*** | (2006.01) |
| *B32B 37/26* | (2006.01) |
| *B44C 1/17* | (2006.01) |
| *B65C 9/20* | (2006.01) |

(52) U.S. Cl. ..... 156/519; 156/230; 156/238; 156/250; 156/269; 156/312; 156/465; 156/517; 156/521

(58) Field of Classification Search ..... 156/230, 156/238, 241, 247, 249, 250, 269, 312, 465, 156/469, 517, 519, 521

See application file for complete search history.

(56) References Cited

U.S. PATENT DOCUMENTS

| | | | |
|---|---|---|---|
| 135,145 | A | 1/1873 | Murphy |
| 293,353 | A | 2/1884 | Purvis |

(Continued)

FOREIGN PATENT DOCUMENTS

| | | |
|---|---|---|
| BE | 1007854 | 11/1995 |

(Continued)

OTHER PUBLICATIONS

Reciprocating Mechanisms, Ingenious Mechanisms for Designers and Inventors, Franklin Jones vol. 1.

(Continued)

*Primary Examiner*—Philip C Tucker
*Assistant Examiner*—Sonya Mazumdar
(74) *Attorney, Agent, or Firm*—Ryan Kromholz & Manion S.C.

(57) ABSTRACT

A method and apparatus for applying tape tabs to a traveling web of material, for example, placement of tape tabs on a running web of disposable undergarments. A pair of wheels each has a protuberance come in contact with the running web of material, which comes in contact with an infeeding tape web. The invention allows placement of tape tabs at asymmetrical spacings, where placement of the tape from contact of the first wheel and protuberance may not be equally or centrally spaced from placement of the tape by the second wheel and protuberance.

20 Claims, 2 Drawing Sheets

U.S. PATENT DOCUMENTS

| | | | | |
|---|---|---|---|---|
| 312,257 | A | | 2/1885 | Cotton et al. |
| 410,123 | A | | 8/1889 | Stilwell |
| 432,742 | A | | 7/1890 | Stanley |
| 643,821 | A | | 2/1900 | Howlett |
| 1,393,524 | A | | 10/1921 | Grupe |
| 1,605,842 | A | | 11/1926 | Jones |
| 1,686,595 | A | | 10/1928 | Belluche |
| 1,957,651 | A | | 5/1934 | Joa |
| 2,009,857 | A | | 7/1935 | Potdevin |
| 2,054,832 | A | | 9/1936 | Potdevin |
| 2,117,432 | A | | 5/1938 | Linscott |
| 2,128,746 | A | | 8/1938 | Joa |
| 2,131,808 | A | | 10/1938 | Joa |
| 2,164,408 | A | | 7/1939 | Joa |
| 2,167,179 | A | | 7/1939 | Joa |
| 2,171,741 | A | | 9/1939 | Cohn et al. |
| 2,213,431 | A | | 9/1940 | Joa |
| 2,254,290 | A | | 9/1941 | Joa |
| 2,254,291 | A | | 9/1941 | Joa |
| 2,282,477 | A | | 5/1942 | Joa |
| 2,286,096 | A | | 6/1942 | Joa |
| 2,296,931 | A | | 9/1942 | Joa |
| 2,304,571 | A | | 12/1942 | Joa |
| 2,324,930 | A | | 7/1943 | Joa |
| 2,345,937 | A | | 4/1944 | Joa |
| 2,466,240 | A | | 4/1949 | Joa |
| 2,481,929 | A | | 9/1949 | Joa |
| 2,510,229 | A | | 6/1950 | Joa |
| 2,540,844 | A | | 2/1951 | Strauss |
| 2,584,002 | A | | 1/1952 | Elser et al. |
| 2,591,359 | A | | 4/1952 | Joa |
| 2,618,816 | A | | 11/1952 | Joa |
| 2,702,406 | A | | 2/1955 | Reed |
| 2,721,554 | A | | 10/1955 | Joa |
| 2,730,144 | A | | 1/1956 | Joa |
| 2,772,611 | A | | 12/1956 | Heywood |
| 2,780,253 | A | | 2/1957 | Joa |
| 2,785,609 | A | | 3/1957 | Billeb |
| 2,811,905 | A | | 11/1957 | Kennedy, Jr. |
| 2,839,059 | A | | 6/1958 | Joa |
| 2,842,169 | A | | 7/1958 | Joa |
| 2,851,934 | A | | 9/1958 | Heywood |
| 2,875,724 | A | | 3/1959 | Joa |
| 2,913,862 | A | | 11/1959 | Sabee |
| 2,939,461 | A | | 6/1960 | Joa |
| 2,960,143 | A | | 11/1960 | Joa |
| 2,990,081 | A | | 6/1961 | Neui et al. |
| 2,991,739 | A | | 7/1961 | Joa |
| 3,016,207 | A | | 1/1962 | Comstock |
| 3,016,582 | A | | 1/1962 | Joa |
| 3,017,795 | A | | 1/1962 | Joa |
| 3,020,687 | A | | 2/1962 | Joa |
| 3,021,135 | A | | 2/1962 | Joa |
| 3,024,957 | A | | 3/1962 | Pinto |
| 3,053,427 | A | | 9/1962 | Wasserman |
| 3,054,516 | A | | 9/1962 | Joa |
| 3,069,982 | A | | 12/1962 | Heywood et al. |
| 3,086,253 | A | | 4/1963 | Joa |
| 3,087,689 | A | | 4/1963 | Heim |
| 3,091,408 | A | | 5/1963 | Schoeneman |
| 3,114,994 | A | | 12/1963 | Joa |
| 3,122,293 | A | | 2/1964 | Joa |
| 3,128,206 | A | | 4/1964 | Dungler |
| 3,203,419 | A | | 8/1965 | Joa |
| 3,230,955 | A | | 1/1966 | Joa et al. |
| 3,268,954 | A | | 8/1966 | Joa |
| 3,288,037 | A | | 11/1966 | Burnett |
| 3,289,254 | A | | 12/1966 | Joa |
| 3,291,131 | A | | 12/1966 | Joa |
| 3,301,114 | A | | 1/1967 | Joa |
| 3,322,589 | A | | 5/1967 | Joa |
| 3,342,184 | A | | 9/1967 | Joa |
| 3,356,092 | A | | 12/1967 | Joa |
| 3,360,103 | A | | 12/1967 | Johnson |
| 3,363,847 | A | | 1/1968 | Joa |
| 3,391,777 | A | | 7/1968 | Joa |
| 3,454,442 | A | | 7/1969 | Heller, Jr. |
| 3,470,848 | A | | 10/1969 | Dreher |
| 3,484,275 | A | | 12/1969 | Lewicki, Jr. |
| 3,502,322 | A | | 3/1970 | Cran |
| 3,521,639 | A | | 7/1970 | Joa |
| 3,526,563 | A | | 9/1970 | Schott, Jr. |
| 3,538,551 | A | | 11/1970 | Joa |
| 3,540,641 | A | | 11/1970 | Besnyo et al. |
| 3,575,170 | A | | 4/1971 | Clark |
| 3,607,578 | A | * | 9/1971 | Berg et al. ..... 156/552 |
| 3,635,462 | A | | 1/1972 | Joa |
| 3,656,741 | A | | 4/1972 | Macke et al. |
| 3,666,611 | A | | 5/1972 | Joa |
| 3,673,021 | A | | 6/1972 | Joa |
| 3,685,818 | A | | 8/1972 | Burger |
| 3,728,191 | A | | 4/1973 | Wierzba et al. |
| 3,751,224 | A | | 8/1973 | Wackerle |
| 3,772,120 | A | * | 11/1973 | Radzins ..... 156/264 |
| 3,796,360 | A | | 3/1974 | Alexeff |
| 3,816,210 | A | | 6/1974 | Aoko et al. |
| 3,847,710 | A | * | 11/1974 | Blomqvist et al. ..... 156/511 |
| 3,854,917 | A | | 12/1974 | McKinney et al. |
| 3,883,389 | A | | 5/1975 | Schott, Jr. |
| 3,888,400 | A | | 6/1975 | Wiig |
| 3,903,768 | A | | 9/1975 | Amberg et al. |
| 3,904,147 | A | | 9/1975 | Taitel et al. |
| 3,918,698 | A | | 11/1975 | Coast |
| 3,960,646 | A | | 6/1976 | Wiedamann |
| 3,991,994 | A | | 11/1976 | Farish |
| 4,002,005 | A | | 1/1977 | Mueller et al. |
| 4,003,298 | A | | 1/1977 | Schott, Jr. |
| 4,009,814 | A | | 3/1977 | Singh |
| 4,009,815 | A | | 3/1977 | Ericson et al. |
| 4,053,150 | A | | 10/1977 | Lane |
| 4,056,919 | A | | 11/1977 | Hirsch |
| 4,081,301 | A | | 3/1978 | Buell |
| 4,090,516 | A | | 5/1978 | Schaar |
| 4,094,319 | A | | 6/1978 | Joa |
| 4,103,595 | A | | 8/1978 | Corse |
| 4,106,974 | A | | 8/1978 | Hirsch |
| 4,108,584 | A | | 8/1978 | Radzins et al. |
| 4,136,535 | A | | 1/1979 | Audas |
| 4,141,193 | A | | 2/1979 | Joa |
| 4,141,509 | A | | 2/1979 | Radzins |
| 4,142,626 | A | | 3/1979 | Bradley |
| 4,157,934 | A | | 6/1979 | Ryan et al. |
| 4,165,666 | A | | 8/1979 | Johnson et al. |
| 4,168,776 | A | | 9/1979 | Hoeboer |
| 4,171,239 | A | | 10/1979 | Hirsch et al. |
| 4,205,679 | A | | 6/1980 | Repke et al. |
| 4,208,230 | A | | 6/1980 | Magarian |
| 4,213,356 | A | | 7/1980 | Armitage |
| 4,215,827 | A | | 8/1980 | Roberts et al. |
| 4,222,533 | A | | 9/1980 | Pongracz |
| 4,223,822 | A | | 9/1980 | Clitheroe |
| 4,231,129 | A | | 11/1980 | Winch |
| 4,236,955 | A | | 12/1980 | Prittie |
| 4,275,510 | A | | 6/1981 | George |
| 4,284,454 | A | | 8/1981 | Joa |
| 4,307,800 | A | | 12/1981 | Joa |
| 4,316,756 | A | * | 2/1982 | Wilson ..... 156/227 |
| 4,342,206 | A | | 8/1982 | Rommel |
| 4,364,787 | A | | 12/1982 | Radzins |
| 4,374,576 | A | | 2/1983 | Ryan |
| 4,379,008 | A | | 4/1983 | Gross et al. |
| 4,394,898 | A | | 7/1983 | Campbell |
| 4,411,721 | A | | 10/1983 | Wishart |
| 4,452,597 | A | | 6/1984 | Achelpohl |

4,492,608 A 1/1985 Hirsch et al.
4,501,098 A 2/1985 Gregory
4,508,528 A 4/1985 Hirsch et al.
4,522,853 A 6/1985 Szonn et al.
4,551,191 A 11/1985 Kock et al.
4,586,199 A 5/1986 Birring
4,589,945 A * 5/1986 Polit ..... 156/497
4,601,771 A * 7/1986 Wesley ..... 156/215
4,603,800 A 8/1986 Focke et al.
4,614,076 A 9/1986 Rathemacher
4,619,357 A 10/1986 Radzins et al.
4,634,482 A 1/1987 Lammers
4,641,381 A 2/1987 Heran et al.
4,642,150 A 2/1987 Stemmler
4,642,839 A 2/1987 Urban
4,650,530 A 3/1987 Mahoney et al.
4,663,220 A 5/1987 Wisneski et al.
4,672,705 A 6/1987 Bors et al.
4,675,062 A * 6/1987 Instance ..... 156/227
4,693,056 A 9/1987 Raszewski
4,701,239 A * 10/1987 Craig ..... 156/519
4,726,874 A 2/1988 VanVliet
4,726,876 A 2/1988 Tomsovic et al.
4,743,241 A 5/1988 Igaue et al.
4,751,997 A 6/1988 Hirsch
4,753,429 A 6/1988 Irvine et al.
4,756,141 A 7/1988 Hirsch et al.
4,764,325 A 8/1988 Angstadt
4,765,780 A 8/1988 Angstadt
4,776,920 A 10/1988 Ryan
4,777,513 A 10/1988 Nelson
4,782,647 A 11/1988 Williams et al.
4,785,986 A 11/1988 Daane et al.
4,795,510 A * 1/1989 Wittrock et al. ..... 156/64
4,801,345 A 1/1989 Dussaud et al.
4,802,570 A 2/1989 Hirsch et al.
4,840,609 A 6/1989 Jones et al.
4,845,964 A 7/1989 Bors et al.
4,859,945 A * 8/1989 Stokar ..... 324/309
4,864,802 A 9/1989 D'Angelo
4,880,102 A 11/1989 Indrebo
4,888,231 A 12/1989 Angstadt
4,892,536 A 1/1990 Des Marais et al.
4,904,440 A 2/1990 Angstadt
4,908,175 A 3/1990 Angstadt
4,909,019 A 3/1990 Delacretaz et al.
4,925,520 A 5/1990 Beaudoin et al.
4,927,322 A 5/1990 Schweizer et al.
4,927,582 A 5/1990 Bryson
4,937,887 A 7/1990 Schreiner
4,963,072 A 10/1990 Miley et al.
4,987,940 A 1/1991 Straub et al.
4,994,010 A 2/1991 Doderer-Winkler
5,000,806 A 3/1991 Merkatoris et al.
5,021,111 A 6/1991 Swenson
5,025,910 A 6/1991 Lasure et al.
5,045,039 A 9/1991 Bay
5,062,597 A 11/1991 Martin et al.
5,064,179 A 11/1991 Martin
5,080,741 A 1/1992 Nomura et al.
5,094,658 A 3/1992 Smithe et al.
5,096,532 A 3/1992 Neuwirth et al.
5,108,017 A 4/1992 Adamski et al.
5,109,767 A 5/1992 Nyfeler et al.
5,110,403 A 5/1992 Ehlert
5,127,981 A 7/1992 Straub et al.
5,131,525 A 7/1992 Musschoot
5,147,487 A 9/1992 Nomura et al.
5,163,594 A 11/1992 Meyer
5,171,239 A 12/1992 Igaue et al.
5,176,244 A 1/1993 Radzins et al.
5,183,252 A 2/1993 Wolber et al.
5,188,627 A 2/1993 Igaue et al.
5,195,684 A 3/1993 Radzins
5,203,043 A 4/1993 Riedel
5,213,645 A 5/1993 Nomura et al.
5,223,069 A 6/1993 Tokuno et al.
5,226,992 A 7/1993 Morman
5,246,433 A 9/1993 Hasse et al.
5,267,933 A 12/1993 Precoma
5,308,345 A 5/1994 Herrin
5,328,438 A 7/1994 Crowley
5,340,424 A 8/1994 Matsushita
5,368,893 A 11/1994 Sommer et al.
5,407,513 A 4/1995 Hayden et al.
5,415,649 A 5/1995 Watanabe et al.
5,421,924 A 6/1995 Ziegelhoffer et al.
5,424,025 A 6/1995 Hanschen et al.
5,429,576 A * 7/1995 Doderer-Winkler ..... 493/214
5,435,802 A 7/1995 Kober
5,449,353 A 9/1995 Watanabe et al.
5,464,401 A 11/1995 Hasse et al.
5,486,253 A 1/1996 Otruba
5,494,622 A 2/1996 Heath et al.
5,531,850 A * 7/1996 Herrmann ..... 156/161
5,540,647 A 7/1996 Weiermann et al.
5,545,275 A 8/1996 Herrin et al.
5,545,285 A 8/1996 Johnson
5,552,013 A 9/1996 Ehlert et al.
5,556,360 A 9/1996 Kober et al.
5,556,504 A 9/1996 Rajala et al.
5,560,793 A 10/1996 Ruscher et al.
5,602,747 A 2/1997 Rajala
5,624,420 A 4/1997 Bridges et al.
5,624,428 A 4/1997 Sauer
5,628,738 A 5/1997 Suekane
5,634,917 A 6/1997 Fujioka et al.
5,643,165 A 7/1997 Klekamp
5,643,396 A 7/1997 Rajala et al.
5,645,543 A 7/1997 Nomura et al.
5,659,229 A 8/1997 Rajala
5,660,657 A 8/1997 Rajala et al.
5,660,665 A 8/1997 Jalonen
5,683,376 A 11/1997 Kato et al.
RE35,687 E 12/1997 Igaue et al.
5,693,165 A 12/1997 Schmitz
5,699,653 A 12/1997 Hartman et al.
5,707,470 A 1/1998 Rajala et al.
5,711,832 A 1/1998 Glaug et al.
5,725,518 A 3/1998 Coates
5,745,922 A 5/1998 Rajala et al.
5,746,869 A * 5/1998 Hayden et al. ..... 156/265
5,749,989 A 5/1998 Linman et al.
5,788,797 A 8/1998 Herrin et al.
5,817,199 A 10/1998 Brennecke et al.
5,829,164 A 11/1998 Kotitschke
5,836,931 A 11/1998 Toyoda et al.
5,858,012 A 1/1999 Yamaki et al.
5,865,393 A 2/1999 Kreft et al.
5,868,727 A 2/1999 Barr et al.
5,876,027 A 3/1999 Fukui et al.
5,876,792 A 3/1999 Caldwell
5,879,500 A 3/1999 Herrin et al.
5,902,431 A 5/1999 Wilkinson et al.
5,932,039 A 8/1999 Popp et al.
5,938,193 A 8/1999 Bluemle et al.
5,964,970 A 10/1999 Woolwine et al.
6,036,805 A 3/2000 McNichols
6,043,836 A 3/2000 Kerr et al.
6,050,517 A 4/2000 Dobrescu et al.
6,074,110 A 6/2000 Verlinden et al.
6,076,442 A 6/2000 Arterburn et al.
6,098,249 A 8/2000 Toney et al.
6,123,792 A 9/2000 Samida et al.
6,183,576 B1 2/2001 Couillard et al.
6,210,386 B1 4/2001 Inoue

| | | | | |
|---|---|---|---|---|
| 6,212,859 | B1 | 4/2001 | Bielik, Jr. et al. | |
| 6,250,048 | B1 | 6/2001 | Linkiewicz | |
| 6,264,784 | B1 | 7/2001 | Menard et al. | |
| 6,276,421 | B1 | 8/2001 | Valenti et al. | |
| 6,306,122 | B1 | 10/2001 | Narawa et al. | |
| 6,309,336 | B1 | 10/2001 | Muessig et al. | |
| 6,312,420 | B1 | 11/2001 | Sasaki et al. | |
| 6,314,333 | B1 | 11/2001 | Rajala et al. | |
| 6,315,022 | B1 | 11/2001 | Herrin et al. | |
| 6,336,921 | B1 | 1/2002 | Kato et al. | |
| 6,358,350 | B1 | 3/2002 | Glaug et al. | |
| 6,369,291 | B1 | 4/2002 | Uchimoto et al. | |
| 6,375,769 | B1 | 4/2002 | Quereshi et al. | |
| 6,391,013 | B1 | 5/2002 | Suzuki et al. | |
| 6,416,697 | B1 | 7/2002 | Venturino et al. | |
| 6,443,389 | B1 | 9/2002 | Palone | |
| 6,446,795 | B1 | 9/2002 | Allen et al. | |
| 6,473,669 | B2 | 10/2002 | Rajala et al. | |
| 6,475,325 | B1 * | 11/2002 | Parrish et al. | 156/265 |
| 6,478,786 | B1 | 11/2002 | Gloug et al. | |
| 6,482,278 | B1 | 11/2002 | McCabe et al. | |
| 6,494,244 | B2 | 12/2002 | Parrish et al. | |
| 6,521,320 | B2 | 2/2003 | McCabe et al. | |
| 6,524,423 | B1 * | 2/2003 | Hilt et al. | 156/265 |
| 6,551,228 | B1 | 4/2003 | Richards | |
| 6,551,430 | B1 | 4/2003 | Glaug et al. | |
| 6,554,815 | B1 | 4/2003 | Umebayashi | |
| 6,572,520 | B2 | 6/2003 | Blumle | |
| 6,581,517 | B1 | 6/2003 | Becker et al. | |
| 6,596,108 | B2 | 7/2003 | McCabe | |
| 6,605,172 | B1 | 8/2003 | Anderson et al. | |
| 6,605,173 | B2 | 8/2003 | Glaug et al. | |
| 6,637,583 | B1 | 10/2003 | Andersson | |
| 6,648,122 | B1 | 11/2003 | Hirsch et al. | |
| 6,649,010 | B2 | 11/2003 | Parrish et al. | |
| 6,659,150 | B1 | 12/2003 | Perkins et al. | |
| 6,659,991 | B2 | 12/2003 | Suckane | |
| 6,675,552 | B2 | 1/2004 | Kunz et al. | |
| 6,684,925 | B2 * | 2/2004 | Nagate et al. | 156/540 |
| 6,766,817 | B2 | 7/2004 | da Silva | |
| D497,991 | S | 11/2004 | Otsubo et al. | |
| 6,820,671 | B2 * | 11/2004 | Calvert | 156/543 |
| 6,837,840 | B2 | 1/2005 | Yonekawa et al. | |
| 6,840,616 | B2 | 1/2005 | Summers | |
| 6,852,186 | B1 * | 2/2005 | Matsuda et al. | 156/230 |
| 6,875,202 | B2 | 4/2005 | Kumasaka et al. | |
| 6,893,528 | B2 * | 5/2005 | Middelstadt et al. | 156/264 |
| 6,918,404 | B2 | 7/2005 | Dias da Silva | |
| 6,978,486 | B2 * | 12/2005 | Zhou et al. | 2/400 |
| 7,066,586 | B2 | 6/2006 | da Silva | |
| 7,077,393 | B2 | 7/2006 | Ishida | |
| 7,172,666 | B2 | 2/2007 | Groves et al. | |
| 7,214,174 | B2 | 5/2007 | Allen et al. | |
| 7,247,219 | B2 | 7/2007 | O'Dowd | |
| 7,452,436 | B2 * | 11/2008 | Andrews | 156/249 |
| 2001/0012813 | A1 | 8/2001 | Bluemle | |
| 2001/0017181 | A1 * | 8/2001 | Otruba et al. | 156/64 |
| 2002/0046802 | A1 | 4/2002 | Tachibana et al. | |
| 2002/0059013 | A1 | 5/2002 | Rajala et al. | |
| 2002/0096241 | A1 * | 7/2002 | Instance | 156/64 |
| 2003/0000620 | A1 | 1/2003 | Herrin et al. | |
| 2003/0015209 | A1 | 1/2003 | Gingras et al. | |
| 2003/0052148 | A1 | 3/2003 | Rajala et al. | |
| 2003/0066585 | A1 | 4/2003 | McCabe | |
| 2003/0083638 | A1 | 5/2003 | Malee | |
| 2003/0084984 | A1 | 5/2003 | Glaug et al. | |
| 2003/0089447 | A1 | 5/2003 | Molee et al. | |
| 2003/0135189 | A1 | 7/2003 | Umebayashi | |
| 2004/0007328 | A1 | 1/2004 | Popp et al. | |
| 2004/0016500 | A1 | 1/2004 | Tachibana et al. | |
| 2004/0112517 | A1 | 6/2004 | Groves et al. | |
| 2004/0164482 | A1 | 8/2004 | Edinger | |
| 2005/0000628 | A1 | 1/2005 | Norrley | |
| 2005/0196538 | A1 | 9/2005 | Sommer et al. | |
| 2005/0230056 | A1 * | 10/2005 | Meyer et al. | 156/517 |
| 2005/0230449 | A1 | 10/2005 | Meyer et al. | |
| 2005/0233881 | A1 | 10/2005 | Meyer | |
| 2005/0234412 | A1 | 10/2005 | Andrews et al. | |
| 2005/0257881 | A1 | 11/2005 | Coose et al. | |
| 2005/0275148 | A1 | 12/2005 | Beaudoin et al. | |
| 2006/0021300 | A1 | 2/2006 | Tada et al. | |
| 2006/0137298 | A1 | 6/2006 | Oshita et al. | |
| 2006/0224137 | A1 | 10/2006 | McCabe et al. | |
| 2006/0265867 | A1 | 11/2006 | Schaap | |
| 2007/0074953 | A1 | 4/2007 | McCabe | |

FOREIGN PATENT DOCUMENTS

| | | |
|---|---|---|
| CA | 1146129 | 5/1983 |
| CA | 1153345 | 9/1983 |
| CA | 1190078 | 7/1985 |
| CA | 1210744 | 9/1986 |
| CA | 1212132 | 9/1986 |
| CA | 1236056 | 5/1988 |
| CA | 1249102 | 1/1989 |
| CA | 1292201 | 11/1991 |
| CA | 1307244 | 9/1992 |
| CA | 1308015 | 9/1992 |
| CA | 1310342 | 11/1992 |
| CA | 2023816 | 3/1994 |
| CA | 2404154 | 10/2001 |
| CA | 2541194 | 1/2006 |
| CA | 2559517 | 5/2007 |
| DE | 102006047280 | 4/2007 |
| EP | 0044206 | 1/1982 |
| EP | 0048011 | 3/1982 |
| EP | 0089106 | 9/1983 |
| EP | 0304140 | 8/1987 |
| EP | 0439897 | 2/1990 |
| EP | 0455231 | 11/1991 |
| EP | 510251 | 10/1992 |
| EP | 0652175 | 5/1995 |
| EP | 0811473 | 12/1997 |
| EP | 0901780 | 3/1999 |
| EP | 990588 | 4/2000 |
| EP | 1132325 | 9/2001 |
| EP | 1272347 | 1/2003 |
| EP | 1571249 | 9/2005 |
| EP | 1619008 | 1/2006 |
| EP | 1707168 | 4/2006 |
| ES | 509706 | 11/1982 |
| ES | 520559 | 12/1983 |
| ES | 296211 | 12/1987 |
| FR | 2255961 | 7/1975 |
| FR | 0206208 | 12/1986 |
| FR | 2891811 | 4/2007 |
| GB | 1501 | 1/1912 |
| GB | 439897 | 12/1935 |
| GB | 856389 | 12/1960 |
| GB | 941073 | 11/1963 |
| GB | 1096373 | 12/1967 |
| GB | 1126539 | 9/1968 |
| GB | 1346329 | 2/1974 |
| GB | 1412812 | 11/1975 |
| GB | 2045298 | 10/1980 |
| GB | 2115775 A * | 9/1983 |
| GB | 2288316 | 10/1995 |
| JP | 428364 | 1/1992 |
| JP | 542180 | 2/1993 |
| JP | 576566 | 3/1993 |
| JP | 626160 | 2/1994 |
| JP | 626161 | 2/1994 |
| JP | 6197925 | 7/1994 |
| JP | 10035621 | 2/1998 |
| JP | 10-277091 | 10/1998 |
| SE | 0602047 | 5/2007 |

| | | |
|---|---|---|
| WO | WO 9747810 | 12/1997 |
| WO | WO 9907319 | 2/1999 |
| WO | WO9907319 | 2/1999 |
| WO | WO9913813 | 3/1999 |
| WO | WO9965437 | 12/1999 |
| WO | WO0143682 | 6/2001 |
| WO | WO0172237 | 10/2001 |
| WO | WO2005075163 | 1/2005 |

OTHER PUBLICATIONS

Office Action; Date Mailed: Nov. 2, 2006; pp. 4; Cited Art: 1 pg.
Response to Office Action; Amendment A; Dated: Feb. 5, 2007.
Office Action; Date Mailed: May 2, 2007; pp. 6; Cited Art; 1 Pg.
Response to Office Action; Amendment B; Dated: Sep. 4, 2007.
Office Action; Date Mailed: Nov. 14, 2007; pp. 7; Cited Art: 1 pg.
Response to Office Action; Amendment C; Dated: May 16, 2008.

* cited by examiner

MULTIPLE TAPE APPLICATION METHOD AND APPARATUS

RELATED APPLICATION

This application claims the benefit of U.S. Provisional Patent Application Ser. No. 60/563,634, filed 20 Apr. 2004, and entitled "Multiple Tape Application Method and Apparatus."

BACKGROUND OF THE INVENTION

The present invention relates to processes and apparatus for applying tabs to traveling webs, and more specifically to application of multiple tabs to a traveling web. The invention has particular applicability to the manufacture of disposable diapers.

The history of cutting and applying tape tabs to disposable diaper webs is now in its fourth decade. Over the course of that time, various types of automatic manufacturing equipment have been developed which produce the desired results with a variety of materials and configurations. This equipment generally included window-knife and slip-and-cut applicators, each having their own advantages and limitations.

Window-knife applicators are comprised of: one or more rotating heads, each made up of a knife edge and a vacuum plate; a more or less stationary knife, which is configured with a hole (window); and a tape transfer mechanism. Typically, the rotating heads are mechanically configured so as to eliminate head rotation relative to the stationary knife. Each head is passed, once per cycle, across the face of the stationary window knife, through which the infeeding tape is passed. The rotating knife shears the extended length of tape against the sharp inner edge of the hole (window), after which the severed segment is held by the vacuum plate. The rotating head, with the segment of tape held in place by the vacuum plate, continues through its rotation to a point, usually 90 degrees later, where it contacts the traveling web, which is pressed against the exposed adhesive of the tape segment. This contact, usually against some backing device, effects a transfer of the tape tab from the vacuum plate to the traveling web, which then carries the tape tab downstream.

Window-knife applicators have a few shortcomings, among which are: the difficulty in feeding tape webs with little axial stiffness; the tendency of the infeeding tape to adhere to the window knife-edge; and for exposed adhesive to contaminate the surfaces of the window knife. For effective cutting, some degree of interference between the cutting edges is necessary between the moving and stationary knife faces, so to minimize impact, precision in manufacturing must be maintained and provision must be made for a degree of resiliency. While applicators of this type have been tested to speeds of 1000 cuts per minute, the maximum practical speed capability of current designs is approximately 750 cuts per minute.

Slip-and-cut applicators are typically comprised of (a) a cylindrical rotating vacuum anvil (b) a rotating knife roll and (c) a transfer device. In typical applications, a tape web is fed at a relatively low speed along the vacuum face of the rotating anvil, which is moving at a relatively higher surface speed and upon which the tape web is allowed to "slip". A knife-edge, mounted on the rotating knife roll, cuts a segment of tape from the tape web against the anvil face. This knife-edge is preferably moving at a surface velocity similar to that of the anvil's circumference. Once cut, the tape tab is held by vacuum drawn through holes on the anvil's face as it is carried at the anvil's speed downstream to the transfer point where the tape segment is transferred to the traveling web.

A common problem with slip-and-cut applicators lies in the tendency to accumulate various contaminants on their anvil surfaces. This is most frequently seen in the form of the release compounds found on the non-adhesive side of tape, which is shipped on pre-wound rolls. Where die-cut tapes are fed onto the surfaces of slip-and-cut applicators, it is common to also see an accumulation of adhesive contamination, as the adhesive has been exposed at the tape edges by the die-cutting process. The difference in speed between the tape web and the anvil tends to "wipe" adhesive from the tape web. Contamination of the anvil, whether by release compounds or by fugitive adhesive, interferes with the regularity of slip occurring between the tape and the anvil, causing registration and cut accuracy problems. Frequent cleaning is necessary to maintain any level of productivity.

Another problem associated with slip-and-cut applicators occurs at the point of cut. Since the web being cut is traveling at a very low velocity compared to the anvil and knife velocity (perhaps 1/20th), the engagement of the knife with the tape web tends to induce a high tensile strain in the tape web. Having been placed under such a high level of stress, the tape web can recoil violently when the cut is finally completed, causing loss of control of the tape web. This "snap-back" effect increases with the thickness of the tape web. Thicker webs tend to prolong the duration of engagement with the knife before completion of the cut, thereby increasing the build-up of strain. This is a common process problem that is usually addressed by the provision of various shock-absorbing devices. One possible solution might have been to reduce the surface velocity of the knife, but substantially different velocities between the knife and anvil result in rapid wear of the knife edge and/or anvil face, depending on relative hardness.

Continual improvements and competitive pressures have incrementally increased the operational speeds of disposable diaper converters. As speeds increased, the mechanical integrity and operational capabilities of the applicators had to be improved accordingly. As a further complication, the complexity of the tape tabs being attached has also increased. Consumer product manufacturers are offering tapes which are die-cut to complex profiles and which may be constructed of materials incompatible with existing applicators. For instance, a proposed tape tab may be a die-profiled elastic textile, instead of a typical straight-cut stiff-paper and plastic type used in the past. Consequently, a manufacturer may find itself with a window-knife applicator, which cannot feed a tape web with too little axial stiffness. It could also find itself with a slip-and-cut applicator, which cannot successfully apply die-cut tape segments. Furthermore, existing applicators cannot successfully apply tapes whose boundaries are fully profiled, as may be desired to eliminate sharp corners, which might irritate a baby's delicate skin. This demonstrates a clear need for an improved applicator capable of applying new tape configurations and overcoming other shortcomings of some prior art applicators.

To overcome these shortcomings, Parish et al. (U.S. Pat. No. 6,475,325), which has been assigned to the same assignee as the present application, discloses an applicator and method that allows tape tabs to be applied to a running web of material, even when the web of tape tab material is moving at a different speed than the web of material. A protuberance acting against the web of material brings the web into contact with the tape tabs and adheres the tape tabs to the web. While this invention adequately solved many of the problems of the prior art, it did not address the placement of non-uniformly distributed tape tabs on the web of material.

SUMMARY OF THE INVENTION

The present invention has the added capability over the prior art of applying two tape tabs to a web of material, even when the tape tabs are not to be placed uniformly or evenly spaced on the web.

The invention provides the additional benefit of quiet operation compared to prior art equipment, which use high speed cutting faces and suffers from the effects of the very high energy levels seen at the point of contact. Generally, these energies, and the sounds that they generate, increase in proportion to the square of the velocity. The present invention benefits from the relatively low speed of the cutting faces and exhibits extremely low noise levels. In fact, the underlying noise of the mechanical drive systems and the traveling web equipment contribute to make the cutting noise level nearly unnoticeable.

The present invention provides a simplified process wherein a rotary knife or die, with one or more cutting edges, turns against and in coordination with a corresponding vacuum anvil cylinder. An infeeding tape web is fed along the surface of the anvil, which is rotating at a surface velocity equal to or only somewhat greater than that of the tape web. As the tape web passes the nip created between the knife-edges and the anvil surface, segments of tape are parted but not significantly displaced upon the anvil surface. The segments continue downstream on the anvil surface, held securely by forces induced by a vacuum source directed to one or more holes provided for each segment in the anvil surface.

The pattern of vacuum holes for alternating segments on the anvil surface are connected to internal vacuum zones within the anvil roll that are separate from the internal vacuum zones connected to the adjacent pattern of vacuum holes. The vacuum zone for the first tape segment to be applied ends at a different point than the vacuum zone for the second tape segment to be applied because the transfer position of the second tape is axially displaced relative to the transfer position of the first tape. Also, the alternating pattern of vacuum holes may be different because the length of the first tape segment to be applied may be longer or shorter than the length of the second tape segment to be applied (e.g., the first tape might be 25 mm while the second tape might be 35 mm). Each vacuum zone may incorporate a vacuum commutation system as described later.

At a point downstream along the surface of the anvil, the traveling web to which the segments are to be attached is brought into close proximity with the anvil and its tape segments. A mechanically operated device, which may be as simple as a first protuberance on a first rotating cylinder, presses the target zone of the traveling web against the exposed adhesive of the tape segment as it is presented on the anvil surface. The first protuberance preferably has a surface velocity substantially identical to that of the traveling web.

At a point angularly upstream of the first protuberance, a second protuberance mounted on a second rotating cylinder presses the target zone of the traveling web against the exposed adhesive of a successive tape segment presented on the anvil surface. The displacement angle of the second protuberance is centered with the center of the anvil. The transfer point of the second protuberance is located upstream from the transfer point of the first protuberance. The protuberances are arranged in such a fashion that the second protuberance will not interfere with transfer of tape for the first protuberance.

Given the extremely low moment of inertia of the tape segments and the aggressive adhesion provided between its exposed adhesive and the compatible surface of the traveling web, each successive segment is successfully transferred to the traveling web, accelerating almost instantly to the speed of the traveling web.

A key aspect of this invention lies in the method and apparatus used to affect the transfer of the tape segments from the anvil to the traveling web. In accordance with the invention, a vacuum commutation system is configured to remove or reduce the level of vacuum used to hold each tape segment to the anvil surface just before the point of transfer. The materials and finishes selected for the anvil and the transfer protuberances provide a situation in which the coefficient of friction between the protuberances and the traveling web is relatively high, while the coefficient of friction between the tape segment and the anvil is relatively low. The highly aggressive nature of the bond between the adhesive side of the tape segment and the target surface of the traveling web ensures that there is virtually no slippage between the two. This ensures that the traveling web is driven through the point of transfer at its existing velocity, and that any tendency of the tape segment to adhere to the anvil surface will not influence the traveling web. The process requires that some slip occurs, and in accordance with the invention, slip occurs only between the tape segment and the anvil surface.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
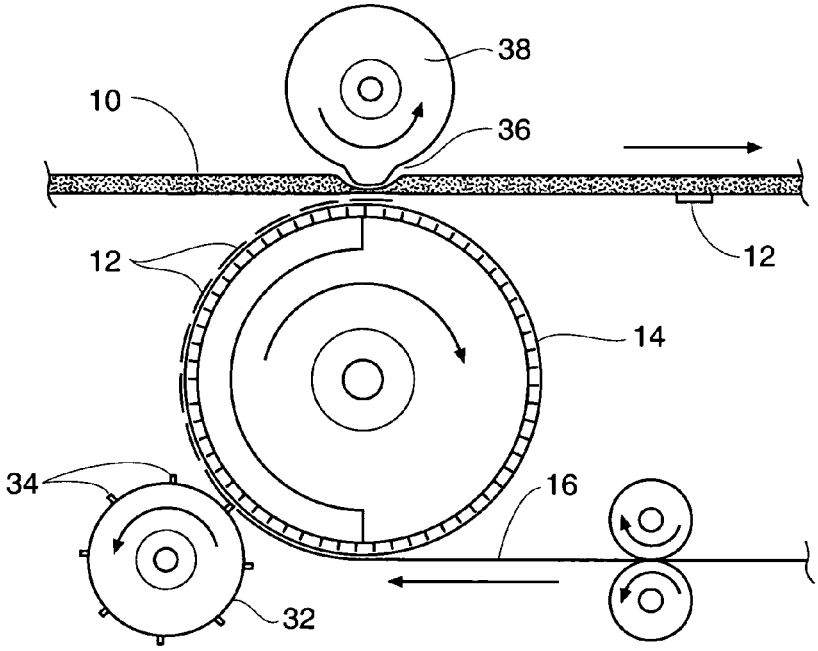
Fig. 1 PRIOR ART
FIG. 1 is a diagrammatic side view illustrating a Prior Art process applying a single tape tab.

Referring to FIG. 1, the apparatus and process of the Prior Art is shown in diagrammatic fashion. In accordance with the invention, the web 16 is fed to the anvil 14 at a speed such that the web speed of web 16 approximately equals the speed at which the outer periphery of anvil 14 is traveling. If desired, the anvil 14 may rotate at a slightly higher speed than the linear speed of the web 16. The blades 34 of a rotary cutter 32 are also traveling at a peripheral speed equal to that of anvil 14. After cutting the web 16, a series of tabs 12 are carried on the outer surface of anvil 14. Tabs 12 are held in place by vacuum provided within the interior of anvil 14. The adhesive-coated surface of web 16 is facing outwardly while a non-tacky or uncoated surface engages the exterior anvil 14.

A web 10 is caused to travel in a path slightly displaced from the outer surface of rotating anvil 14, but in close proximity thereto. Just above the web 10 is a rotating wheel 38, which rotates at a peripheral velocity equal to the lineal velocity of web 10, which, in turn, is substantially greater than the peripheral velocity of anvil 14.

Wheel 38 has a protrusion 36 which extends along its width. The rotational speed of roller 38 is selected so that the protrusion 36 engages web 10 and displaces it into contact with each successive adhesive-coated tab 12. The slight displacement of web 10 causes it to come into contact with the tab segment 12 which, then, is instantly adhered to the higher speed traveling web 10. The coefficient of friction between the uncoated side of tab 12 and the metal surface of anvil 14 is low so that the aggressive adhesion between tab 12 and web 10 together with the extremely low moment of inertia of tape tab segment 12 facilitates successful transfer of the tabs 12 to the web 10, the tabs 12 accelerating almost instantly to the higher speed of web 10.

Figure 2:
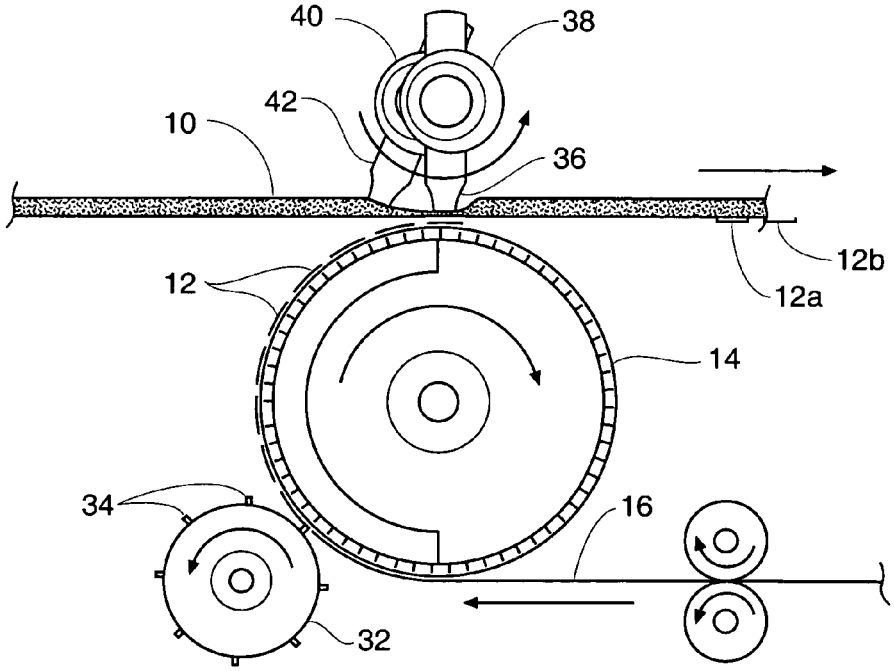
FIG. 2 is a diagrammatic side view illustrating a preferred process of the present invention.

Now referring to FIG. 2, the improved design of the present invention is shown in a side diagrammatic view. Near where the wheel 38 engages the web 10 with the protrusion 36, a second wheel 40 with a second protrusion 42 is located. The second wheel 40 is located upstream of the first wheel 38. Because the second wheel 40 is located upstream of the first wheel 38, the vertical displacement of the web by the second protrusion 42 is greater than that of the first protrusion 36. The second protrusion 42 will not interfere with the placement of the tab 12*b* by the first protrusion 36 because the first protrusion 36 will have already made a rotation and the tab 12*b* will have already traveled downstream. The second protrusion 42 allows placement of the tabs 12*a* onto the web 10 at symmetrically spaced intervals with other tabs 12*a* placed by the second protrusion 42, but are asymmetrically spaced intervals relative to the tabs 12*b* placed by the first protrusion 36.

Figure 3:
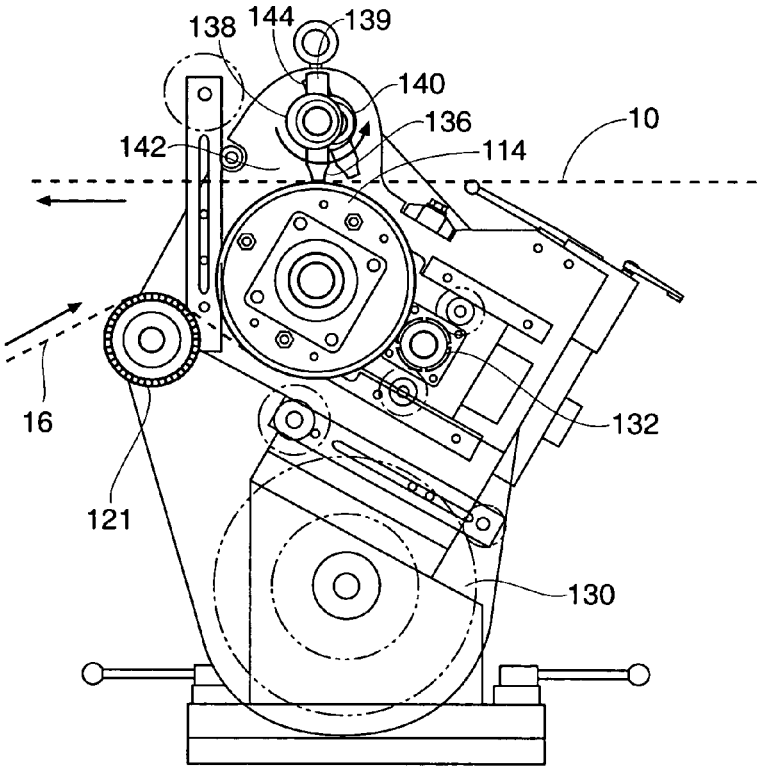
FIG. 3 is a side view illustrating a further embodiment of the invention.
Figure 4:
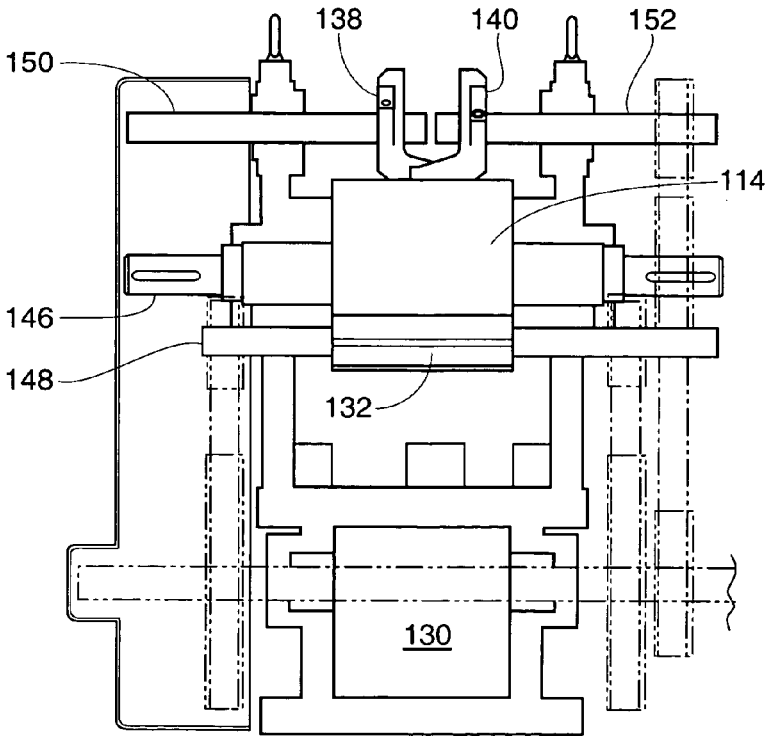
FIG. 4 is a front elevational view of the equipment of FIG. 3.

Referring to FIGS. 3 and 4, as particularly viewed in FIG. 3, web 10 is traveling to the left and adhesive-backed tape 16 is fed over a roller 121 onto an anvil/drum 114. Tape web 16 is cut into individual tape tabs by a rotary cutter 132. As the tape tab segments 12 travel to the top of drum 114 as viewed in FIG. 2, a lobe 136 located on a rotatable wheel 138 intermittently impacts the web 10. A counterweight 139 located opposite of the lobe 136 on the rotatable wheel provides for an even rotation of the wheel 138. A second rotatable wheel 140 holds a second lobe 142 that also intermittently impacts the web 10. The second wheel 140 has a second counterweight 144 to balance the rotation of the second wheel 140 and counteract the second lobe 142. The first wheel 138 and the second wheel 140 have the same cycle time, but will impact the web 10 at different times for preventing interference of the two wheels 138 and 140. Also, the second wheel 140 will impact the web 10 slightly farther upstream on the web 10 than the first wheel 138 impacts the web, thereby further preventing interference of the two wheels 138 and 140. Preferably, first wheel 138 impacts the web 10 first followed by impact of second wheel 150. A motor or power supply 130 drives the apparatus, through various mechanical drive connections generally shown by dotted or phantom lines in FIG. 4.

A front view of the embodiment of FIG. 3 is shown in FIG. 4. A shaft 146 rotatably drives the rotatable anvil 114. The rotary cutter 132 is mounted on another shaft 148 while the rotatable wheel 138 is mounted on a shaft 150 and the second rotatable wheel 140 mounted on another shaft 152. The arrangement of the wheels 138 and 140 mounted on separate shafts 150 and 152, respectively, allows for position displacement of wheel 140 with respect to wheel 138 and for easier replacement of wheels 138 and 140. Adjustment may be done on one of the wheels without necessarily needing to adjust the timing on the other wheel. In a preferred embodiment, the position of wheel 140 is adjustable, and the position of wheel 138 is fixed.

The wheels 138 and 140 may be timed to have any spaced interval between them, provided that the interval is sufficient for the protuberances 136 and 142 to have sufficient clearance as they pass the web 10.

We claim:

1. An apparatus for applying tape segments onto a moving web, the apparatus comprising:

a first protrusion in intermittent contact with a moving web, said intermittent contact with said web causing said web to engage a first adhesive patch;

a second protrusion in intermittent contact with said web, said intermittent contact with said web causing said web to engage a second adhesive patch;

said first and said second adhesive patches applied to a single product; and said first protrusion and said second protrusion contacting said web at different times, wherein the first and second protrusion contact the web at generally the same location in the cross-machine direction and different locations in the machine direction.

2. An apparatus according to claim 1, wherein said first protrusion is coupled to a rotating wheel.

3. An apparatus according to claim 1, wherein said first protrusion is coupled to a counterweight.

4. An apparatus according to claim 1, wherein said second protrusion is coupled to a rotating wheel.

5. An apparatus according to claim 1, wherein said second protrusion is coupled to a counterweight.

6. An apparatus according to claim 1, said first adhesive patch carried in proximity to said web by an anvil roll.

7. An apparatus according to claim 6, said anvil roll comprising a pattern of vacuum holes on a surface of said anvil roll to carry said first adhesive patch.

8. An apparatus according to claim 7, said vacuum holes coupled to a means for drawing a vacuum within said anvil roll.

9. An apparatus according to claim 8, said adhesive patch comprising a first side carrying an adheringly effective amount of adhesive and a second side carrying an adheringly ineffective amount of adhesive, said first side facing said web, said second side facing said anvil roll.

10. An apparatus according to claim 9, said apparatus further comprising means for feeding a continuous web of adhesive-backed tape onto said anvil roll, a knife roll positioned to cut said web of adhesive-backed tape against said anvil roll, creating a continuous stream of adhesive-backed tape segments held to said surface of said anvil roll by said vacuum within said anvil roll.

11. An apparatus for applying tape segments onto a moving web, the apparatus comprising:

a traveling web positioned in proximity to an anvil roll, an adhesive surface carried by said anvil roll, a first and a second spaced apart protuberance on a first and a second rotatable cylinder, said first and second protuberance being sized and configured for intermittently displacing said traveling web at a first and a second transfer position into contact into contact with the adhesive surface, thereby adhering said adhesive surface to said traveling web at a first and a second contact point, and a first shaft affixed to said first rotatable cylinder and a second shaft affixed to said second rotatable cylinder, said first shaft and said second shaft being axially displaced from each other around the center of said anvil roll.

12. An apparatus according to claim 11, said anvil roll further comprising a pattern of vacuum holes for carrying said adhesive surface.

13. An apparatus according to claim 12, said adhesive surface comprising a first and a second segment, said first segment longer than said second segment.

14. An apparatus according to claim 12, said pattern of vacuum holes comprising a first and a second vacuum zone within said anvil roll.

15. An apparatus according to claim 14, wherein said first and said second vacuum zones have different levels of vacuum applied to said zones.

16. An apparatus according to claim 11, the apparatus further comprising a means for feeding said adhesive surface onto the surface of said anvil roll at a lineal-velocity substantially equal to or less than a surface velocity of said anvil roll.

17. An apparatus according to claim 11, the apparatus further comprising a knife roll comprising a plurality of cutting edges, said cutting edges turning against said anvil roll in coordination with a pattern of vacuum holes provided said anvil roll, said cutting edges having a knife-edge surface velocity substantially equal to a surface velocity of said anvil roll.

18. An apparatus according to claim 17, said knife roll comprising a rotary die.

19. An apparatus according to claim 11, wherein said first protuberance has a surface velocity substantially equal to a lineal velocity of said traveling web.

20. An apparatus according to claim 11, wherein said axial displacement of said first and second shafts is variable to allow selection of different spacing between adhesive surfaces.

* * * * *